US005315739A

United States Patent [19]

Herman

[11] Patent Number: 5,315,739

[45] Date of Patent: May 31, 1994

[54] DECORATIVE MULTI-PART ORNAMENTATIONS AND THE FABRICATION THEREOF

[75] Inventor: Michael Herman, Huntington, N.Y.

[73] Assignee: Herman Pearl Button Co., Inc., New York, N.Y.

[21] Appl. No.: 44,263

[22] Filed: Apr. 7, 1993

Related U.S. Application Data

[63] Continuation-in-part of Ser. No. 843,457, Feb. 28, 1992, Pat. No. 5,255,417, which is a continuation-in-part of Ser. No. 737,066, Jul. 29, 1991, abandoned, and a continuation-in-part of Ser. No. 805,322, Dec. 10, 1991, abandoned.

[51] Int. Cl.[5] ..... A44B 1/04

[52] U.S. Cl. ..... 24/113 MP

[58] Field of Search ..... 24/90 R, 92, 113 R, 24/113 MP, 90 A, 90 C, 90 E, 90 TA

[56] References Cited

U.S. PATENT DOCUMENTS

| | | |
|---|---|---|
| D. 337,967 | 8/1993 | Wright . |
| Re. 32,500 | 9/1987 | Takata . |
| 56,791 | 7/1866 | Overbaugh . |
| 316,253 | 4/1885 | Fox . |
| 327,442 | 9/1885 | Hyde, Jr. . |
| 748,411 | 12/1903 | Neuberth . |
| 757,744 | 4/1904 | Hornich, Jr. . |
| 758,758 | 10/1903 | Keplinger . |
| 1,227,501 | 2/1916 | Styles . |
| 1,292,588 | 1/1919 | Devine . |
| 1,867,424 | 4/1932 | Smith . |
| 1,927,221 | 1/1932 | Schnarr . |
| 2,087,074 | 8/1936 | Tucker . |
| 2,220,038 | 8/1937 | Kreisler, et al. . |
| 2,354,513 | 11/1942 | Fitzer . |
| 2,674,107 | 4/1954 | Bodnar . |
| 2,860,395 | 10/1955 | Anderson . |
| 2,993,250 | 7/1961 | Decker . |
| 3,133,331 | 5/1964 | Maricorena . |
| 3,303,953 | 2/1967 | Frank . |
| 3,414,949 | 2/1967 | Andrews . |
| 3,439,439 | 9/1966 | Stimson . |
| 3,500,507 | 9/1967 | Malhenzie et al. . |
| 3,543,354 | 8/1968 | Schuchman et al. . |
| 3,715,781 | 2/1971 | Salvatori . |
| 4,471,510 | 9/1984 | Derosa . |
| 4,481,696 | 11/1984 | Kanzaka . |
| 4,507,344 | 3/1985 | Baughman . |
| 4,571,781 | 2/1986 | Kanzaka et al. . |
| 4,597,206 | 7/1986 | Benson . |
| 4,742,696 | 5/1988 | Jenkins . |
| 4,793,155 | 12/1988 | Law . |
| 4,858,281 | 8/1989 | Watanabe et al. . |
| 4,891,956 | 1/1990 | MacDonald . |
| 4,899,556 | 2/1990 | Ford . |
| 4,912,829 | 4/1990 | Hickey . |
| 4,959,890 | 10/1990 | Pazurek . |
| 5,033,168 | 7/1991 | Sbragi . |
| 5,093,965 | 3/1992 | Mauras et al. ..... 24/113 MP X |

FOREIGN PATENT DOCUMENTS

| | | |
|---|---|---|
| 109153 | 5/1988 | China . |
| 132018 | 1/1989 | China . |
| 0419899A1 | 4/1991 | European Pat. Off. . |
| 296164 | 3/1916 | Fed. Rep. of Germany . |
| 701529 | 12/1940 | Fed. Rep. of Germany . |
| 1031730 | 7/1954 | Fed. Rep. of Germany . |
| 1181961 | 11/1964 | Fed. Rep. of Germany . |
| 3614966A1 | 11/1987 | Fed. Rep. of Germany . |
| 1525179 | 4/1968 | France . |
| 18720 | of 1908 | United Kingdom ..... 24/113 R |
| 468004 | 6/1937 | United Kingdom . |
| 1357885 | 6/1974 | United Kingdom . |
| 2242669 | 10/1991 | United Kingdom . |

*Primary Examiner*—James R. Brittain
*Attorney, Agent, or Firm*—Richard S. Roberts

[57] ABSTRACT

Snap-type action securing elements are formed respectively on ornamentation bases and caps so that a number of different ornamentation caps can be disposed for co-action with a single base to fabricate a number of different ornamentation assemblies. The items of ornamentation may be either buttons with the base carrying an anchor or holes to facilitate securing the button to an article; or items of jewelry such as pins, broaches, rings, pendants, earrings, tie tacks and the like with suitable fastening means.

22 Claims, 11 Drawing Sheets

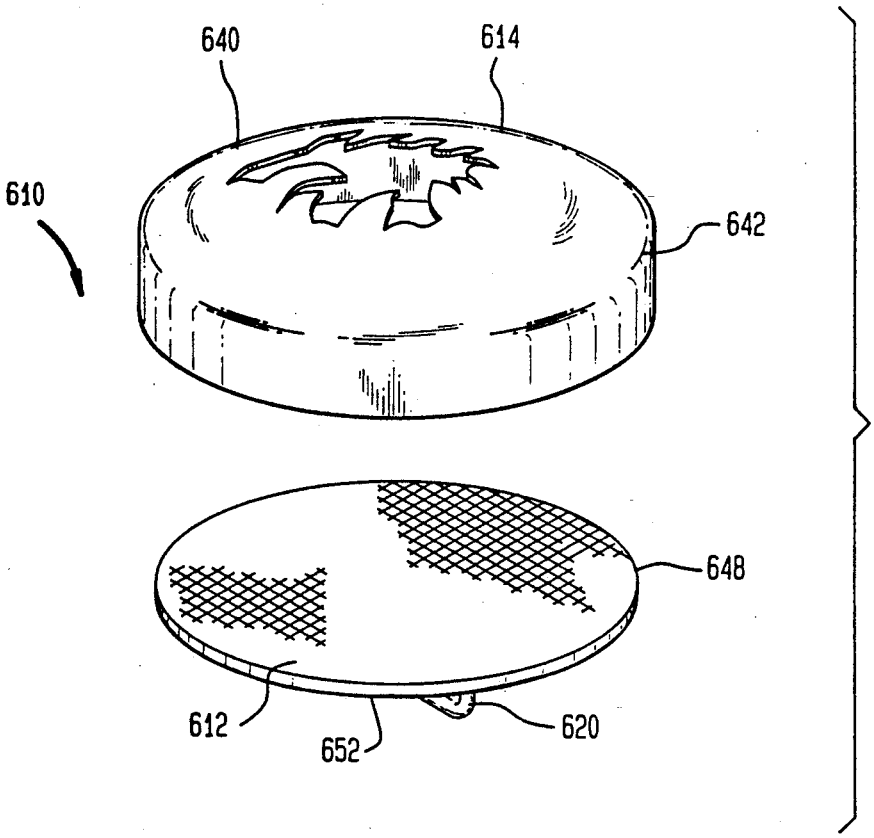
FIG. 12
FIG. 13
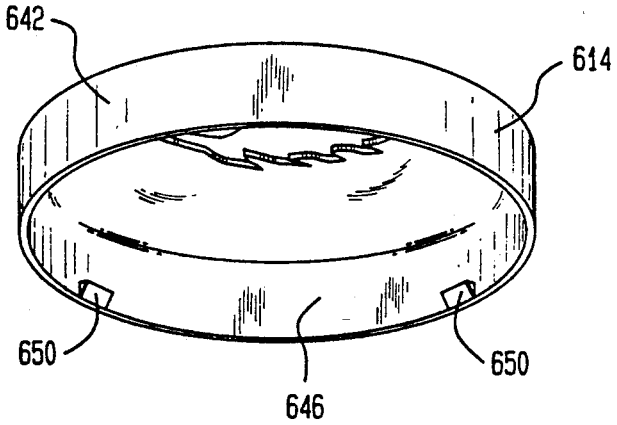
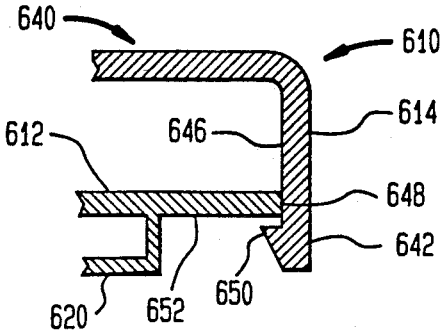
FIG. 14

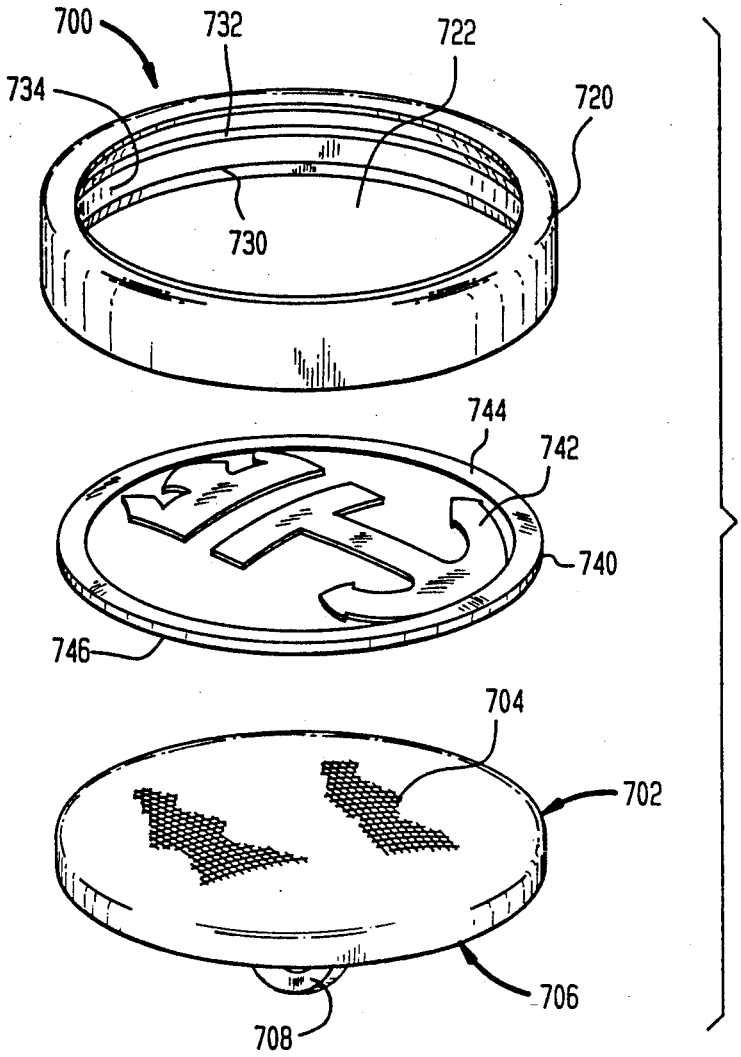
FIG. 15
FIG. 16
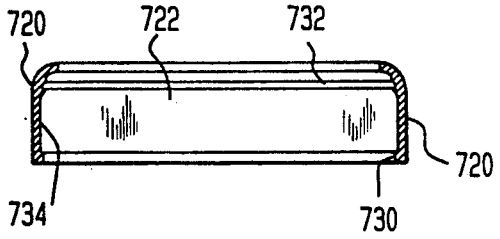
FIG. 17
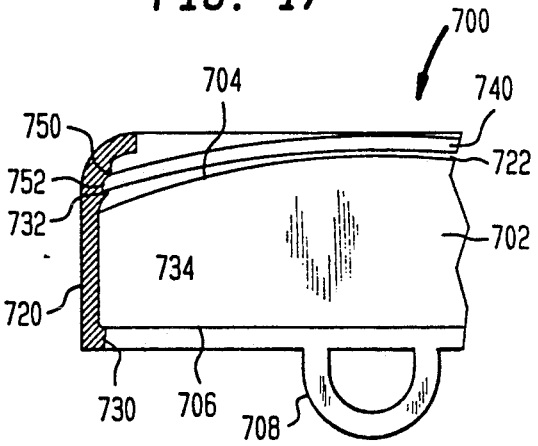

DECORATIVE MULTI-PART ORNAMENTATIONS AND THE FABRICATION THEREOF

CROSS-REFERENCE TO RELATED APPLICATIONS

This application is a continuation-in-part of U.S. patent application Ser. No. 07/843,457 filed Feb. 28, 1992, now U.S. Pat. No. 5,255,417 which was a continuation in part of U.S. patent application Ser. No. 07/737,066 filed Jul. 29, 1991, now abandoned and a continuation in part of U.S. patent application Ser. No. 805,322 filed Dec. 10, 1991, now abandoned, all of which are incorporated herein by reference.

BACKGROUND OF THE INVENTION

This invention relates to ornamentations, and more particularly to multi-part ornamentations particularly in the form of buttons, jewelry and the like and the method of fabrication thereof.

Ornamentations, particularly in the form of buttons and items of jewelry such as broaches, pins, rings, earrings, bracelets, beads, pendants and the like are used extensively to dress-up and decorate households, wearing apparel and one's person.

Buttons, for example, are extensively use on garments and for wearing apparel as fastening devices and for decoration and ornamentation. Jewelry is similarly worn and displayed for like purposes. Buttons and jewelry are also used as fasteners and for ornamentation and decoration for non-garment, non-wearing apparel applications. Accordingly, there is a relatively great need for a large variety of shapes, sizes and configurations for such ornamentations, buttons and jewelry, and for a variety of ornamentation and finishes for such sizes, shapes and configurations.

According to this invention, items of ornamentation generally include a base member or portion which is utilized to facilitate disposition of the item of ornamentation for use. Buttons, for example, include holes or a loop through which thread or other fastening material is passed to attach and secure the button to the garment, wearing apparel or other surface to which the button is to be attached. Jewelry pieces include pins, catches, loops, chains, clips, clasps and a myriad of other devices by which the decorative part of the jewelry item is positioned for show.

The button surface for many buttons is plain and merely displays the material from which the button is made and the particular color or colors selected. However, a considerable number of buttons and most jewelry items are finished in one of many conventional ways, to provide a decorative surface that may, for instance, be secured to a base as by the use of an adhesive as shown, for example, in U.S. Pat. No. 3,715,781. The use of adhesives in ornamentation manufacture is messy, especially for relatively small items such as buttons. It requires a certain amount of dexterity to place the decorative member in place on its base and may result in marring or discoloration of the base by adhesive leaking or otherwise ending up on an exposed portion of the ornamentation piece. This patent also provides for snapping a decorative member for the button in place but this form of manufacture limits the ornamentation carrier to one having a ridge about the decorative member and to one where the decorative member is fabricated from springy material and requires a certain amount of dexterity to spring the decorative member and place it within its ridge.

An alternative multi-part construction is shown in U.S. Pat. No. 3,439,439, but that construction is intended only for use with coins as the decorative element and requires a clevis that is loosely positioned and held in place by the decorative element. Other multi-part constructions are shown in U.S. Pat. Nos. 56,791; 316,253; and 327,442. However these constructions either require relatively small elements which are clearly easily assembled together and just as easily separated or utilize a button base and decorative member that are threadably secured together and as such also relatively easily separated one from the other. In fact, that is the purpose to these constructions, to provide relatively easy separation so that the user may easily make such changes at will. In addition, the use of screw threads on a small item like a button or piece of jewelry or other ornamentation dictates the use of fine threads which may bind and hinder proper assembly and disassembly and therefore the functioning and aesthetics of the item.

Some multi-part constructions use a base part and a decorative part that assembles to the base with a snap type detenting action such as shown in U.S. Pat. Nos. 2,087,074; 3,414,949; 3,133,331; 4,742,696; and 4,959,890. However, all these constructions utilize fastening elements to position the decorative member to its carrier or base that not only snap together but also snap apart just as easily since it is their intention to specifically provide for relatively easy changing by the user as the user desires from time to time. Such fastening elements may also permit separation of the decorative member from the base when not desired and loss of the decorative member. In addition, fastening elements which are utilized again and again lose their functionality with repeated use and may eventually fail to hold the decorative member in place completely.

Spring like or resilient-type fastening elements for securing other type of items together are shown in U.S. Pat. Nos. 2,674,107; 2,860,395; 4,507,344; 4,793,155; 4,891,956; 4,899,556 and 4,912,829. Such constructions also are intended for ready changing by the user and are subject to the deficiencies stated above for buttons and jewelry items with readily interchangeable decorative members.

Other multi-part constructions are shown in U.S. Pat. Nos. 2,220,038; 2,354,513; and 4,471,510. The features that render the ornamentation changeable at will by the user also enables the decorative part to easily separate from its base in use or while laundering or cleaning. Similar deficiencies are obvious for the other constructions.

SUMMARY OF THE INVENTION

It is an object of this invention to provide improved multi-part ornamentation constructions wherein a single base member can be assembled with and have permanently secured thereto a number of different decorative cap members. Specifically, the decorative members, once secured to the base member are substantially inseparable therefrom. The ornamentation can be a button, jewelry or other ornamental object.

Specifically, the invention provides an ornamental assembly comprising:

(a) base means including attaching means for securing said base means to an article;

(b) cap means for co-action with and mounting to said base means;

(c) said base means and said cap means together carrying securing means for non-removably securing said base means and cap means together into an ornamental assembly; said securing means including securing elements which readily co-act to secure said base means and cap means together and which prevent separation of said base means and said cap means.

The invention further provides a button assembly comprising (a) a button base having (i) top and bottom surfaces joined by a smooth peripheral side wall, which wall is in a plane substantially perpendicular to the bottom surface, and (ii) a woven fabric covering the top surface, the peripheral side wall and at least a portion of the bottom surface, and (iii) means for attaching the button assembly to a garment. The button further has (b) a cap comprising a hollow cup-shaped member having a top surface and a wall around the periphery of the top surface, which wall, together with the top surface defines a hollow center capable of receiving the button base, the hollow center having a wall around its inner periphery, at least one protrusion extending outwardly from the inner periphery, which protrusion is capable of locking with said button base by snap together engagement with the bottom surface of the button base to permanently and non-removably secure the button base and the cap together into a button assembly.

The invention also provides a button assembly comprising (a) a button base having (i) top and bottom surfaces joined by a peripheral side wall, which wall is in a plane substantially parallel to the bottom surface, and (ii) means for attaching said button assembly to a garment. The button has (b) a cap comprising a cup-shaped member having a top surface, at least a portion of the top surface having been removed to permit viewing therethrough; a wall around the periphery of the top surface, which wall, together with the top surface defines a hollow center capable of receiving the button base, said cap being capable of co-action with and mounting to said button base. At least one of said base means and said cap means carrying securing means for locking said button base and cap together into a button assembly, which securing means permanently and non-removably secure said button base and cap together and prevents separation of the button base and the cap by a snap together engagement.

The invention still further provides a button assembly comprising (a) a button base having (i) top and bottom surfaces joined by a peripheral side wall, which wall is in a plane substantially parallel to the bottom surface, and (ii) a plurality of holes through the top and bottom surfaces capable of engaging a thread for attaching said button assembly to a garment. The button has (b) a cap comprising a cup-shaped member having a top surface and a wall around the periphery of the top surface, which wall, together with the top surface defines a hollow center capable of receiving the button base, said cap being capable of co-action with and mounting to said button base. At least one of said base means and said cap means carrying securing means for locking said button base and cap together into a button assembly, which securing means permanently and non-removably secure said button base and cap together and prevents separation of the button base and the cap by a snap together engagement.

The invention furthermore provides a method of attaching a button assembly to a garment which comprises (a) providing a button base having (i) top and bottom surfaces joined by a peripheral side wall, which wall is in a plane substantially parallel to the bottom surface, and (ii) means for attaching said button base to a garment. The method (b) provides a cap comprising a cup-shaped member having a top surface and a wall around the periphery of the top surface, which wall, together with the top surface defines a hollow center capable of receiving the button base, said cap being capable of co-action with and mounting to said button base; at least one of said base means and said cap means carrying securing means for locking said button base and cap together into a button assembly, which securing means permanently and non-removably secure said button base and cap together and prevents separation of the button base and the cap by a snap together engagement. The button base and cap being capable of both steps (i) and (ii): (i) first attaching said base to a garment and then forming a button assembly by snapping together said button base and said cap and (ii) first forming a button assembly by snapping together said button base and said cap and then attaching said base to a garment. By the method one performs either step (i) or step (ii).

The invention also provides a method of producing an ornamental assembly comprising:

(a) providing base means including means for attaching said base means to an article; and (b) providing cap means for co-action with and mounting to said base means; and (c) said base means and said cap means together carrying said securing means for non-removably securing said base means and cap means together into a assembly, said securing means including securing elements which readily co-act to secure said base means and cap means together and which prevent separation of said base means and said cap means; said securing elements comprise one or more raised chevron shaped wedge members positioned about an internal or external perimeter wall of said cap means or said base means, and oppositely, a plurality of complementary recessed chevron shaped wedge members positioned about an external or internal perimeter wall of said base means or said cap means whichever does not have the raised chevron members, said raised chevron members and said recessed chevron members being capable of a snap-together engagement with one another, which engagement substantially prevents the movement of said cap means with respect to said base means; and d) snapping together said base means and said cap means and engaging said complementary recessed and raised chevron members.

Other objects, features, and advantages of the invention will be in part discussed and in part apparent from a consideration of the detailed description of the preferred embodiment.

BRIEF DESCRIPTION OF THE DRAWINGS

In the drawings:

FIG. 12 is an exploded perspective view of another item of ornamentation in the configuration of yet another button assembly incorporating the instant invention.

FIG. 13 is a perspective view of the cap or cover for the button assembly of FIG. 11, looking in from the bottom to better show details thereof.

FIG. 14 is an enlarged sectional view of a portion of the cover for the assembly of FIG. 12 showing one of the latching elements of the button assembly of FIGS. 12 and 13.

FIG. 15 is an exploded perspective view of yet another item of ornamentation in the configuration of a finger ring incorporating the instant invention.

FIG. 16 is a vertical sectional view of the cover for the finger ring taken on line 16—16 of FIG. 15.

FIG. 17 is a vertical sectional view of a portion of the cover of FIGS. 15 and 16 enlarged to better show details thereof.

DETAILED DESCRIPTION OF THE PREFERRED EMBODIMENTS

Figure 1:
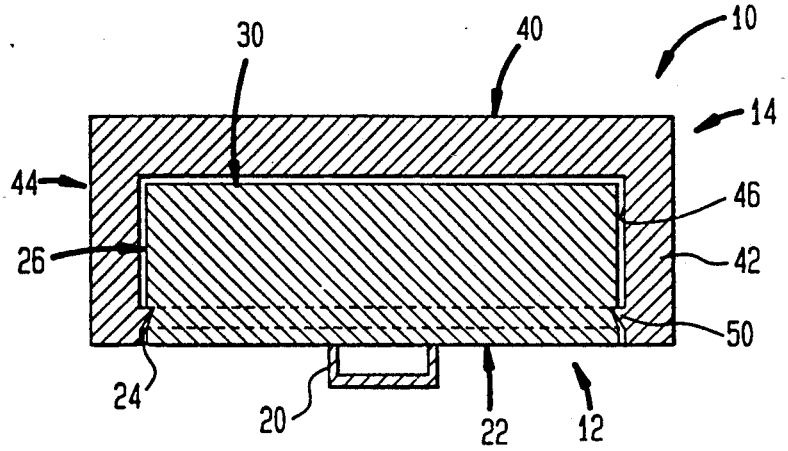
FIG. 1 is a vertical section through an item of ornamentation in the form of a button assembly incorporating the instant invention and enlarged to better show details thereof.

With reference to FIG. 1 there is generally shown at 10 an item of ornamentation in the configuration of a button assembly including a button base member 12 and a button cap member 14 all incorporating the instant invention. Button base 12 is fabricated from materials conventionally utilized to fabricate buttons such as plastic, metal, wood, bone or the like and includes an anchor or loop 20 suitably and conventionally secured to and extending from an underside 22 of button base 12. Anchor or loop 20 is of a size, configuration and disposition to receive a fastening medium such as wire, thread or the like, to facilitate fastening button assembly 10 to an article, such as clothing or the like. A groove 24 is formed in a side surface 26 of button base 12 and extends around the periphery of button base 12 at a predetermined location between underside 22 and a top 30 of button base 12. The button base 12 may be circular, oval, square or any other conventional configuration. If desired, groove 24 may be discontinuous.

Button cap member 14 includes an upper surface 40 and side wall 42 including a side surface 44 depending therefrom thus forming a cap-like member. Surfaces 40 and 44 may, if desired, be decorated with any desired motif, surface texture, color, or other aesthetic design or configuration. Side wall 42 includes an inner surface 46 having an open configuration corresponding to the circumferential configuration of side surface 26 of button base 12. An outwardly extending rib 50 extends about inner surface 46 of side wall 42 at a location thereon to co-act with groove 24 of button base 12. Rib 50 may be discontinuous or continuous and is formed discontinuous if groove 24 is so formed to correspond to and co-act with groove 24.

At least side wall 42 of button cap member 14 is formed to be resilient so that it can snap over button base 12 so that its rib 50 will snap into and co-act with groove 24 to secure button cap member 14 to button base 12. The resilience of side wall 42 and the co-action of rib 50 and groove 24 is selected to permit relatively easy assembly of button cap member 14 and button base member 12 but not permit disassembly thereof.

It is an important feature of this invention that the cap and base members of the assembly be substantially permanently and non-removably attached to one another once they are snapped together. This means that once these parts are united, essentially the only way they can be separated again would be to physically break them apart so that they would subsequently be non-usable, i.e. not re-attachable. This is important since if an item readily disassembles, consumers would find it unacceptable. For example, if a button on a garment comes apart either in a store, or in use, the customer would find that entire garment to be unacceptable. Hence readily detachable buttons, jewelry items and the like would be flimsy and not commercially viable. Also, customers would be of the view that detachable ornamentation items might be a child swallowing hazard. An important feature of this invention is that the ornamentation assemblies must be non-removable once attached. In the preferred embodiment, this non-removable attachment is achieved in the absence of adhesives and with only finger pressure. The attachment is preferably conducted at room temperature and without the addition of heat. In a more preferred embodiment, the ornamentation elements are also non-rotatable with respect to one another and in the most preferred embodiment, the elements are substantially not movable with respect to one another.

The above described button assembly construction permits use of a single button base member with many different button cap members and facilitates the availability of a variety of buttons to a manufacturer of articles of clothing or the like which use such buttons, while at the same time minimizing the number of items in inventory by reducing the number of button bases for making such button assemblies.

Ornamentation 10 of FIG. 1 may just as well be a piece of jewelry such as a ring, broach, pin, pendant, tie tack, one of a pair of earrings or the like with cap member 14 comprising the decorative portion of the piece of jewelry and base member 12 serving as the base for the decorative portion. The size and configuration of such base member 12 and its decorative portion 14 would be selected to provide the size and configuration appropriate to the type and kind of jewelry. Anchor or loop 20 would be modified or removed and replaced by an appropriate and conventionally available attaching or carrying structure such as a finger loop for a ring, a pin with catch for a pin or broach, studs or clips for earrings, or a loop for a pendant and the like.

Figure 2:
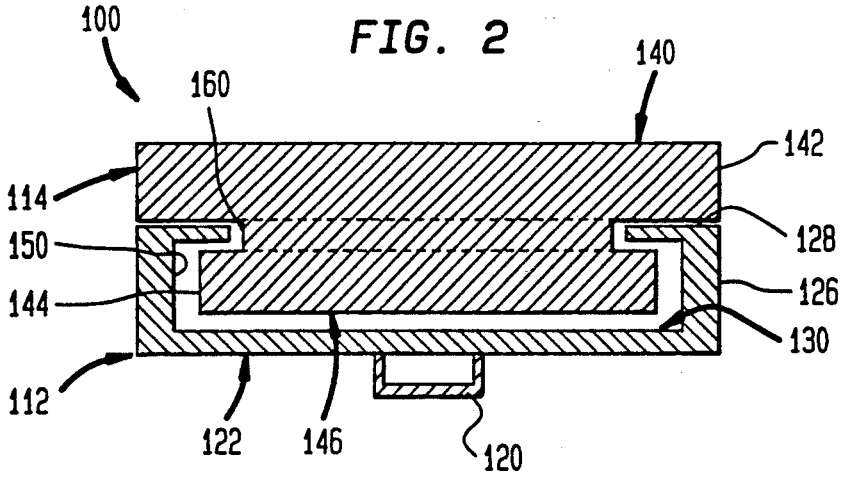
FIG. 2 is a vertical section through an alternative item of ornamentation in the configuration of another button assembly construction incorporating the instant invention enlarged to better show details thereof.

FIG. 2 shows another embodiment of ornamentation in the configuration of a button assembly 100 including a button base member 112 and a button cap member 114 all incorporating the instant invention. Button base member 112, like button base member 12 of the FIG. 1 embodiment, is fabricated from materials conventionally utilized to fabricate buttons and includes an anchor or loop 120 suitably and conventionally secured to and extending from an underside 122 of button base member 112. Anchor or loop 120 is of a size, configuration and disposition to receive a fastening medium, such as wire, thread or the like, to facilitate attaching button assembly 100 to an article such as clothing or the like.

Button base member 112 is generally cup shaped and further includes an upwardly extending side wall 126 about its periphery terminating in an in-turned lip or rib 128 disposed at a predetermined height above a top surface 130 of button base member 112. The circumferential configuration of button base member 112, like that of button base 12 of FIG. 1, may be circular, oval, square, rectangular or any other conventional configuration. If desired lip or rib 128 may be discontinuous or may have fastening means at its tip such as a bead or a hook.

Button cap member 114 includes an upper surface 140, upper side wall 142, lower side wall 144 and a lower surface 146. Surface 140 and the surface of upper side wall 142 may, if desired, be decorated with any selected motif, surface texture, color, or other aesthetic design or configuration. The surfaces of lower side wall 144, and if desired upper side wall 142, are fabricated with a peripheral or circumferential configuration corresponding to that of side wall 126 of button base member 112; with the peripheral configuration of lower side wall 144 of reduced diameter to that of upper side wall 142 and also corresponding to the internal peripheral configuration of lip 128 and of an internal surface 150 of side wall 126 of button base 112. The height of lower side wall 144 is such that lower surface 14 of button cap 114 will not bottom against upper surface 130 of button base member 112.

A circumferential groove 160 extends around the periphery of button cap member 114 at the upper extremity of lower side wall 144 thereof proximate upper side wall 142. Groove 160 may be continuous or discontinuous and if discontinuous along with lip 128, the groove will correspond to rib 128 and co-act therewith as it will if groove 160 is continuous.

At least side wall 126 of button base member 112 is fabricated or formed to be resilient and so that its lip or rib 128 will receive and snap over lower side wall 144 of button cap 114 and into groove 160 to co-act therewith and secure button cap member 114 to button base 112 permanently.

The resilience of side wall 126 of button base member 112 and the co-action of lip 128 thereof with lower side wall 144 and groove 160 is selected to permit relatively easy assembly of button cap member 114 and button base member 112 but not permit disassembly thereof. Thus, the construction of the above described button assembly 100, like that of button assembly 10 of FIG. 1, permits use of a single button base member with many different button cap members and facilitates the availability of a variety of buttons to a manufacturer of articles such as clothing which utilizes such buttons, while at the same time minimizing the number of items of inventory the manufacturer must stock by reducing the number of button base members for making such button assemblies.

Ornamentation 100 of FIG. 2 may just as well be a piece of jewelry such as a ring, broach, pin, pendant, bead, tie tack, one of a pair of earrings or the like, with cap member 140 comprising the decorative portion of the piece of jewelry and with base member 120 serving as the base for the decorative portion. The size and configuration of such base member 120 and its decorative portion 140 would be selected to provide the size and configuration appropriate to the type and kind of jewelry. Anchor or loop 120 would be modified or removed and replaced by an appropriate and conventionally available attaching or carrying structure such as a finger loop for a ring, a pin with catch for a pin or broach, studs or clips for earrings, or a loop for a pendant and the like.

Figure 3:
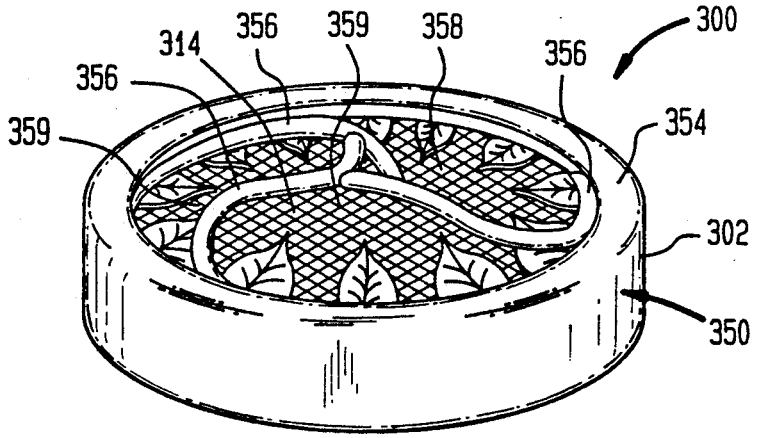
FIG. 3 is a perspective view of another alternative item of ornamentation in the configuration of another button assembly construction incorporating the instant invention and enlarged to better show details thereof.
Figure 4:
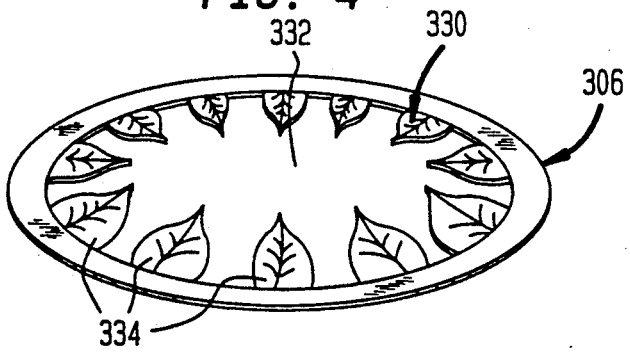
FIG. 4 is a perspective view of an intermediate member of the assembly of FIG. 3.
Figure 5:
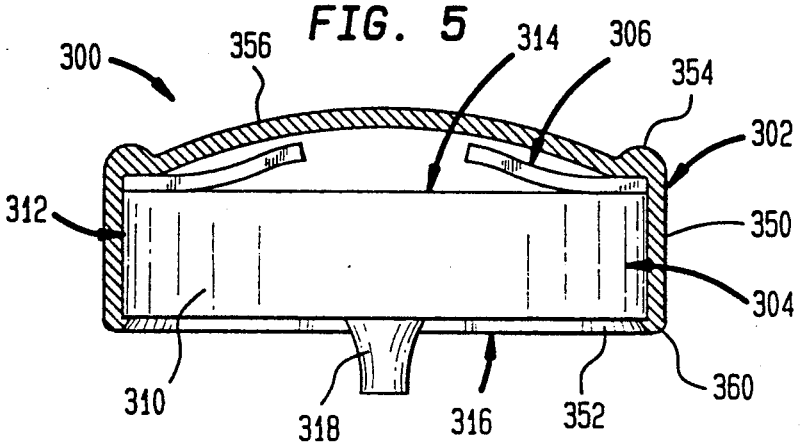
FIG. 5 is a vertical section through the assembly of FIG. 3.

FIGS. 3, 4 and 5 together show yet another embodiment of ornamentation in the configuration of a button assembly 300 incorporating the instant invention. A button ca member 302 is formed to co-act with a button base member 304 and with an intermediate button member 306 disposed therebetween as shown in FIGS. 3 and 5.

Button cap member 302, base member 304, and intermediate member 306 may be fabricated from conventional and available materials usually employed for making buttons as described for the button assemblies of FIGS. 1 and 2, with the material of button cap member 302 being resilient for purposes to be hereinafter described.

As shown in FIG. 5, base member 304 includes a disc-like body 310 having a side surface 312, an upper surface 314 and a lower surface 316 from which extends an anchor or hook 318 formed with an opening (not shown) to receive a fastening member such as a wire or thread (not shown) for purposes of securing button assembly 300 to an article of clothing or the like. At least upper surface 314 of button base member 304 may be decorated like the selected surfaces of button cap members 14 and 114 of the FIG. 1 and 2 embodiments, or if desired the entire body 310 of base member 304 may be covered by a fabric such as cloth, plastic, leather or the like.

Intermediate member 306 is disc-like in that its peripheral configuration conforms to that of button base member 304 and button cap member 302. Intermediate member 306 may be formed of relatively thin material dished upwardly as shown in FIGS. 4 and 5 and with a selected design 330 cut therein and therethrough to form an opening 332 and, if the design so employs, a number of leaf-like elements 334 disposed thereabout. Opening 332 may be centrally and systematically located with leaf-like elements 334 disposed symmetrically thereabout or they may be nonsymmetrically disposed and not centered, as desired. Preferably there is an opening through intermediate member 306 through which upper surface 314 of button base member 302 can be seen. Intermediate member 306 also need not be dished as shown but may be just a relatively flat member.

Button cap member 302 preferably includes a ring-like side wall 350 having a lower opening 352 (FIG. 5) at its bottom, a circumferential rib 354 (FIGS. 3 and 5) around its top edge, and a plurality of lace-like strips 356 spanning an upper opening 358 dividing it into a plurality of smaller openings 359. A bead-like rib or hook 360 (FIG. 5) extends about the circumferential periphery of lower opening 352 for co-action with button base member 304 as will be hereinafter described. The height of side wall 350 is selected so that bead 360 thereof will snap beneath lower surface 316 of button base member 304, when base member 304 is disposed within cap member 302 and when intermediate member 306 is disposed on upper surface 314 of base member 302 as shown in FIG. 5 and co-act with lower surface 316 of base member 304 and side wall 312 thereof to secure button cap member 302 and intermediate member 306 together with button base member 304 to form button assembly 300. The resilience of at least side wall 350 of button cap member 302 permits a relatively easy snapping of cap member 302 over base member 304 and intermediate member 306 and thus assembly of button 300, but does not permit disassembly thereof.

Leaf-like ribs 356 may be of any desired thickness, configuration, disposition and number and need not necessarily completely span upper opening 358. Preferable there are sufficient smaller openings 35 to view intermediate member 306 and button base member 302.

Button assembly 300 thus permits use of a single button base member with many different intermediate and cap members to facilitate the availability of a large variety of buttons as described for the button assemblies of the FIGS. 1 and 2 embodiments.

Ornamentation 300 of the embodiment of FIGS. 3–5 may just as well be a piece of jewelry such as a ring, broach, pin, pendant, bead, tie tack, one of a pair of earrings or the like with cap member 302 and intermediate member 306 comprising the decorative portions of the piece of jewelry and with base member 304 serving as the base for the decorative portions. The size and configuration of such base member 304 and its decorative portions 302, 306 would be selected to provide the size and configuration appropriate to the type and kind of jewelry. Anchor or loop 318 would be modified or removed and replaced by an appropriate and conventionally available attaching or carrying structure such as a finger loop for a ring, a pin with catch for a pin or broach, studs or clips for earrings, or a loop for a pendant and the like.

Figure 6:
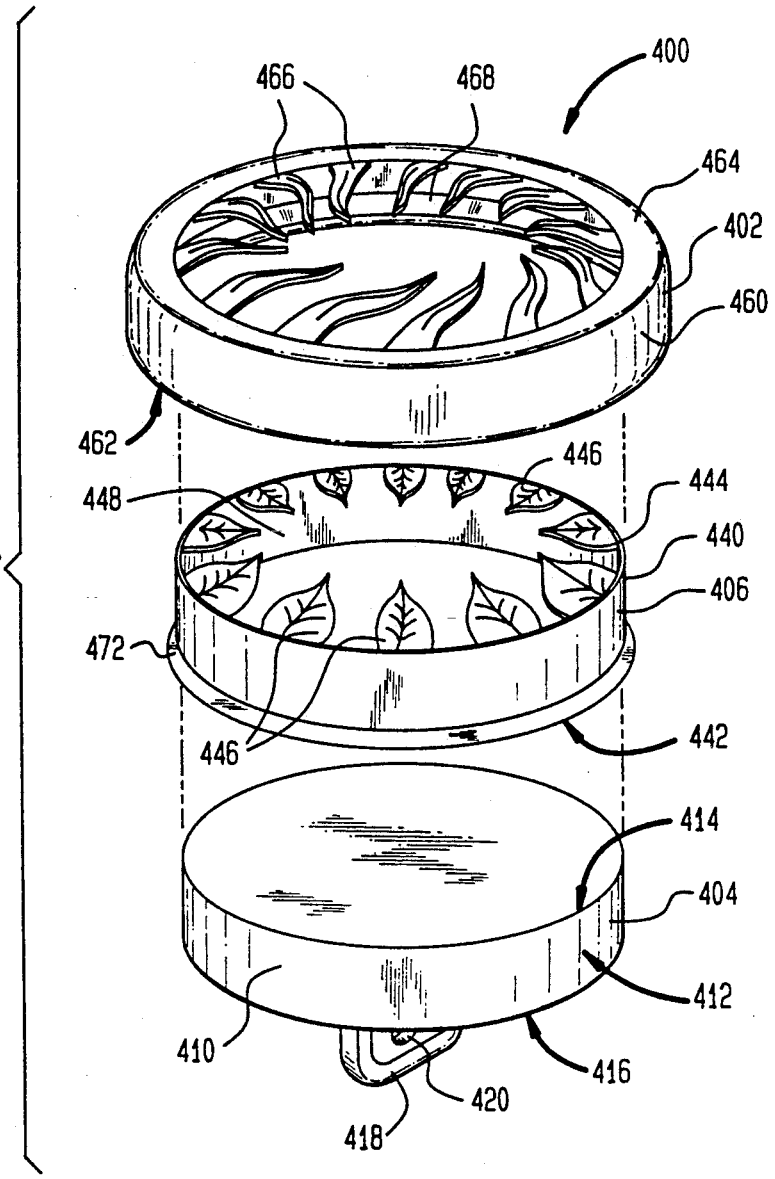
FIG. 6 is an exploded perspective showing of another alternative item of ornamentation in the configuration of still another button assembly construction incorporating the instant invention, enlarged to better show details thereof.
Figure 7:
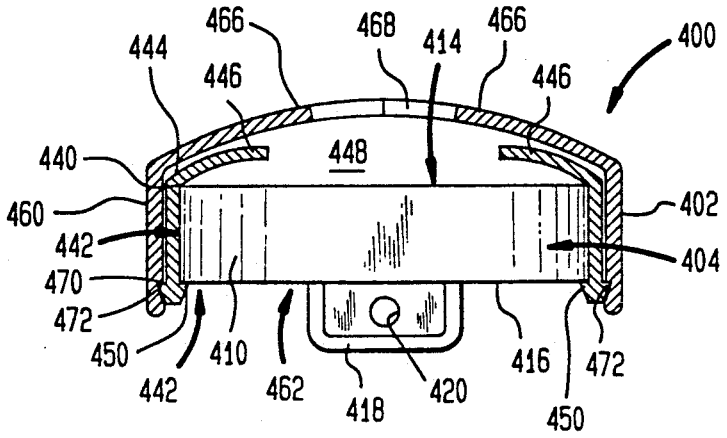
FIG. 7 is a vertical section through the assembled button assembly construction of the button assembly of FIG. 6, further enlarged to better show details thereof.

FIGS. 6 and 7 together show another embodiment of ornamentation in the configuration of a button assembly 400 incorporating the instant invention. A button top-cap member 402 is formed to coact with a button base member 404 with a button intermediate-cap member 406 disposed therebetween. Top-cap member 402, base member 404 and intermediate-cap member 406 may be fabricated from conventional and available materials usually employed for making buttons as described for the other above described button assemblies, with the materials of button top-cap member 402 and intermediate-cap member 406 being resilient for purposes to be hereinafter described.

Button base member 404 includes a disc-like body 410 having a side surface 412, an upper surface 414 and a lower surface 416 from which e>tends an anchor or hook 418 formed with an opening 420 to receive a fastening member such as a wire or thread (not shown) for purposes of securing button assembly 400 to an article of clothing or the like. Upper surface 414 of button base member 404 may be decorated like that of button base member 314 of button assembly 300 (FIGS. 3–5) or like button base member 304, button base member 404 may be covered by fabric such as cloth, plastic, leather or the like.

Button top-cap member 402 and button intermediate-cap member 406 are each cup-like and similar in configuration except that intermediate-cap member 406 is of a size and configuration to snap over and non-removably co-act with button base member 404 and top-cap member 402 is of a size and configuration to snap over and non-removably co-act with both intermediate-cap member 406 and button base member 404.

Button intermediate-cap member 406 may include a ring-like side wall 440 having a lower opening 442 (FIG. 7) at its bottom, a circumferential rib 444 around its top edge and a plurality of leaf-like cut-out members 446 extending into an upper opening 448. A bead-like rib 45 (FIG. 7) extends about the circumferential periphery of lower opening 448 for co-action with button base member 404 as will be hereinafter described. The height of side wall 440 is selected so that bead 450 thereof will snap beneath lower surface 416 of button base member 404, when button base member 404 is disposed within intermediate-cap member 406 as shown in FIG. 7, and will co-act with lower surface 416 and side wall 412 of button base member 404 to secure intermediate-cap member 406 in place permanently.

Top-cap member 402, like intermediate-cap member 406, includes a ring-like side wall 460 having a lower opening 462 (FIG. 7) at its bottom, a circumferential rib 464 around its top-edge and a plurality of leaf-like cut-out members 466 extending into an upper opening 468. A groove 470 extends about the circumferential periphery of an inner surface of top-cap 402 proximate lower opening 448 for co-action with intermediate-cap member 406 and button base member 404 as will be hereinafter described. The height of side wall 460 is selected so that groove 470 thereof will snap onto an outer bead 472 proximate a lower edge of side wall 440 of intermediate-cap member 406, as shown in FIG. 7, when top-cap member 402 is disposed over intermediate-cap member 406 and will co-act with same to secure top-cap member 402 in place permanently.

Leaf-like members 446 of intermediate-cap member 406 and 466 of top-cap member 402 may be of any desired thickness, configuration, disposition, and number and need not necessarily completely span their respective upper openings as long as there is sufficient open space through the tops of the cap members to view the intermediate-cap member leaf-like members through top-cap member 402 and to view button base member 404 through both cap members. If desired, the leaf-like members 446, 466 of either or both cap members may be replaced by cross-ribs as utilized for top member 302 of FIG. 3.

Button assembly 400 thus permits use of a single button base with many different top-cap and intermediate-cap members to facilitate the availability of a large variety of buttons as described for the button assemblies of the previously described embodiments.

Ornamentation 400 of the embodiment of FIGS. 6 and 7 may just as well be a piece of jewelry such as a ring, broach, pin, pendant, bead, tie tack, one of a pair of earrings or the like with cap members 402, 406 comprising the decorative portions of the piece of jewelry and with base member 404 serving as the base for the decorative portions. The size and configuration of such base member 404 and its decorative portions 402, 406 would be selected to provide the size and configuration appropriate to the type and kind of jewelry. Anchor or loop 418 would be modified or removed and replaced by an appropriate and conventionally available attaching or carrying structure such as a finger loop for a ring, a pin with catch for a pin or broach, studs or clips for earrings; or a loop for a pendant and the like.

Figure 8:
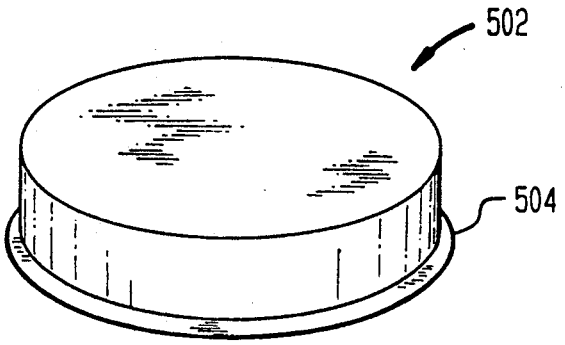
FIG. 8 is a perspective view of another alternative item of ornamentation in the configuration of a button cap, incorporating the instant invention.
Figure 9:
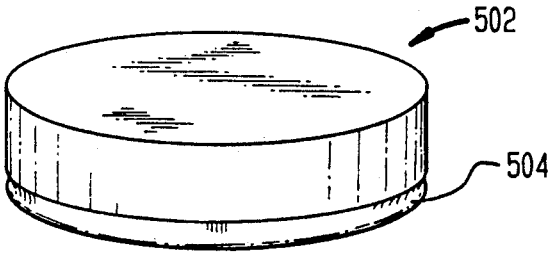
FIG. 9 is another perspective view of the button cap of FIG. 8 with a manufacturing step performed thereon.
Figure 10:
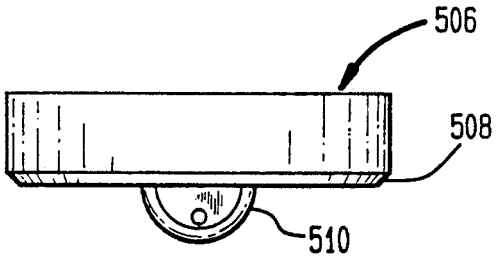
FIG. 10 is a side view of a button base for the button cap of FIGS. 8 and 9.

FIGS. 8–10 shows yet another embodiment of ornamentation in the configuration of a button cap 502. Cap 502 may be made, for example, of metal, such as brass or aluminum. Fitted along a free marginal edge of cap 502 may be a grommet or collar 504. Collar 504 may be made of any suitable material, such as rubber or plastic. Collar 504 may be substantially ring-shaped and may have a slit cut circumferentially (not shown) to admit the marginal edge of the cap 502.

In the next step, the edge of the cap 502 is bent inwardly (as in FIG. 9). A button base 506 is of a similar construction to those disclosed hereinabove. A chamfer 508 (FIG. 10) is formed at the lower or bottom portion of base 506. On assembly, cap 502 is forced over base 506 and collar 504 snapped into chamfer 508 locking cap 502 into position.

Ornamentation 502 of the embodiment of FIGS. 8–10 may just as well be a piece of jewelry such as a ring, broach, pin, pendant, bead, tie tack, one of a pair of earrings or the like with cap member 502 comprising the decorative portion of the piece of jewelry and with base member 506 serving as the base for the decorative portions. The size and configuration of such base member 506 and its decorative portion 502, would be selected to provide the size and configuration appropriate to the type and kind of jewelry. Anchor or loop 510 would be modified or removed and replaced by an appropriate and conventionally available attaching or carrying structure such as a finger loop for a ring, a pin with catch for a pin or broach, studs or clips for earrings, or a loop for a pendant and the like.

Figure 11:
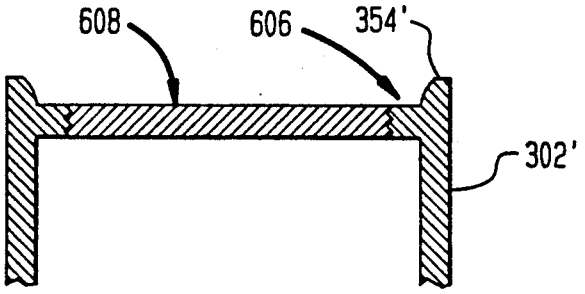
FIG. 11 is a sectioned view of yet another button cap incorporating the instant invention.

It will also be understood that the cap (e.g., the cap of FIG. 4 or 6) may have a central portion internally threaded. Thus, as shown in FIG. 11, a cap 302' may have a threaded opening 606 formed in its top wall adjacent to its circumferential portion 354'. A design-bearing top wall 608 may then be threaded into the top. Once threaded into position, the consumer will not be aware that the design is inserted into the button. This assembly enables the manufacturer to employ any of a multiplicity of design elements to be used with a single shaped cap and base.

It is understood that any of the base members (e.g. 12, 112, 304, 404) can also be a sew-through base member, without the shank construction, as is well known in the art.

While the various ribs 50, 128, 360, 450 and 472 of the respective embodiments of FIGS. 1, 2, 3–5 and 6–7 respectively have been shown as being continuous about the circumference of their respective members, they may just as well be discontinuous as long as there is sufficient rib to co-act with the respective grooves or base members to provide the desired and required secure attachment of caps and bases.

Figure 12A:
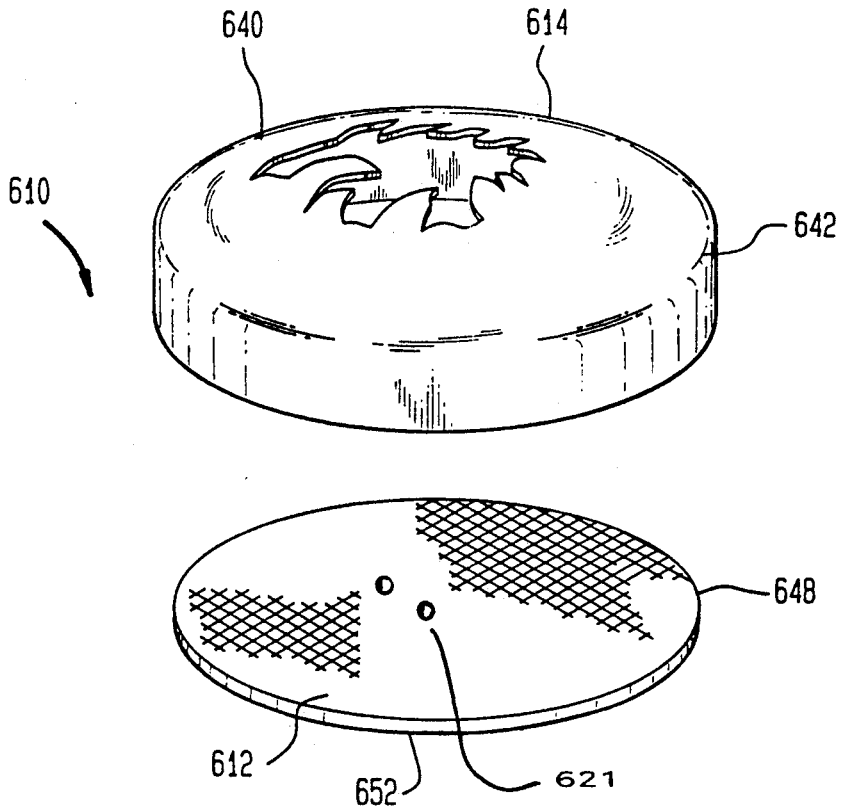
FIG. 12A is an exploded perspective view of a sew through button according to this invention.

With reference to FIGS. 12–14 there is generally shown at 610 a button assembly including a button base member 612 and a button cap member 614 all incorporating the instant invention. Button base 612 is fabricated from materials conventionally utilized to fabricate buttons such as plastic, metal, wood, bone or the like and includes an anchor or loop 620 suitably and conventionally secured to and extending from an underside 652 of button base 612. Anchor or loop 620 is of a size, configuration and disposition to receive a fastening medium such as wire, thread or the like, to facilitate fastening button assembly 610 to an article such as clothing or the like. FIG. 12A shows a button similar to FIG. 12, however sew through holes 621 are provided instead of loop 620. Button cap member 614 includes an upper surface 640 and side wall 642 depending therefrom thus forming a cap-like member. Surfaces 640 may, if desired, be decorated with any desired motif, surface texture, color, or other aesthetic design or configuration. As shown in FIGS. 12 and 12A, in one preferred embodiment of the invention, surface 640 is not continuous, but rather has one or more see through openings in any desired design. This allows the button base member or any optional intermediate members to be seen through the surface. Side wall 642 includes an inner surface 646 (FIGS. 13 and 14) having an open configuration corresponding to the circumferential configuration of side surface 648 (FIGS. 12 and 14) of button base 612. A plurality of inwardly extending ribs or latching elements 650 extend about inner surface 646 of side wall 642 at locations thereon to co-act with bottom surface 652 of button base 612. Latching elements 650 are formed discontinuous and spaced about inner surface 646 and so as to correspond to and co-act with bottom surface 652 of button base 612 for permanent attachment.

At least side wall 642 of button cap member 614 is formed to be resilient and so that it can snap over button base 612 so that latching elements will snap beneath and co-act with bottom surface 652 of button base 612. The resilience of side wall 642 and the co-action of latching elements 650 with button base 652 is selected to permit relatively easy assembly of button cap member 614 and button base member 612 but not to permit disassembly thereof.

The above described button assembly construction thus permits use of a single button base member with many different button cap members and facilitates the availability of a variety of buttons to a manufacturer of articles of clothing or the like, which use such buttons, while at the same time minimizing the number of items in inventory by reducing the number of button bases for making such button assemblies.

Ornamentation 610 of FIGS. 12–14 may just as well be a piece of jewelry such as a ring, broach, pin, pendant, bead, tie tack, one of a pair of earrings or the like with cap member 614 comprising the decorative portion of the piece of jewelry and with base member 612 serving as the base for the decorative portions. The size and configuration of such base member 612 and its decorative portion 614, would be selected to provide the size and configuration appropriate to the type and kind of jewelry. Anchor or loop 620 would be modified or removed and replaced by an appropriate and conventionally available attaching or carrying structure such as a finger loop for a ring, a pin with catch for a pin or broach, studs or clips for earrings, or a loop for a pendant and the like.

FIGS. 15, 16 and 17 together show yet another embodiment of ornamentation in the configuration of a piece of jewelry such as a finger ring 700 incorporating the instant invention. Ring 700 includes a base or body member 702 (FIGS. 15 and 17) formed of suitable and appropriate ring material such as metal (gold, silver, etc.) plastic, wood or the like and having an upper surface 704 which may or may not be decorated and a lower surface 706 to which is secured a finger loop 708 suitably and appropriately sized.

A snap cover 720 (FIGS. 15–17) is formed cap-like and of suitable metal, plastic or other materials and of a size and configuration to receive base body 702 within an inside space 722. A pair of substantially parallel and spaced latching rings or ribs 730, 732 are formed within and extending from an inner surface 734 of cover 720. The lower ring or rib 730 is configured and disposed to co-act with a lower surface of base 702 to retain base 702 and cover 720 positioned one with respect to the other.

An insert 740 (FIGS. 15 and 17) is formed of suitable material such as metal, plastic or the like to provide a decorative effect when disposed between snap cover 720 and base 702 as shown in FIG. 17. Insert 740 may be solid, or cut-out to form a design 742 (FIG. 15) disposed within a circumferential ring 744. Insert 740 is sized and configured to be snapped in place within space 722 of cover 720 and to be secured in position by co-action of ring 744 of insert 740 with latch ring or rib 732 as shown in FIG. 17.

If desired, ring or rib 732 may be formed to co-act with and be spaced from an upper ridge 750 to define with rib 732 a circumferential groove 752 sized and configured to receive and secure in position circumferential ring 744 of insert 740. This construction will permit a pre-assembly of selected inserts 740 and snap covers 720 as a sub-assembly for later combination with base 702.

Latch rings or ribs 730, 732 may be formed continuous as described or as discrete and discontinuous spaced members disposed about and extending from inner surface 734 of snap cover 720.

Ornamentation 700, thus, permits use of a single base member 702 with many different inserts 740 and snap rings 720 to facilitate the availability of a relatively large variety of rings or other pieces of jewelry. For that matter, base 702 may be a button base as described above for the button assembly embodiments; in that form of construction insert 740 and snap cover 720 would be constructed and utilized in manners similar to the cap members and intermediate members of the button assembly constructions of FIGS. 3–5 and 6–7.

Ornamentation 700 of FIGS. 15–17 may also be fabricated as another piece of jewelry such as a broach, pin, pendant, bead, tie tack, or pair of earrings or the like. The size and configuration of base member 702, and its insert 740 and snap cover 720 would be selected to provide the size and configuration appropriate to the type and kind of jewelry. Ring loop 708 would be modified accordingly or removed and replaced by an appropriate and conventionally available attaching or carrying structure such as a pin or catch for a pin or broach, studs or clips for earrings, or a loop for a pendant and the like.

The assembly of FIGS. 15–17 shows a base 702, a cover 720 and a single insert 740 which engages the inside of the cap. It is contemplated that one can provide several levels of similar inserts, each partially overlapping one another inside of the cap 720 in a multi-level arrangement.

Figure 18:
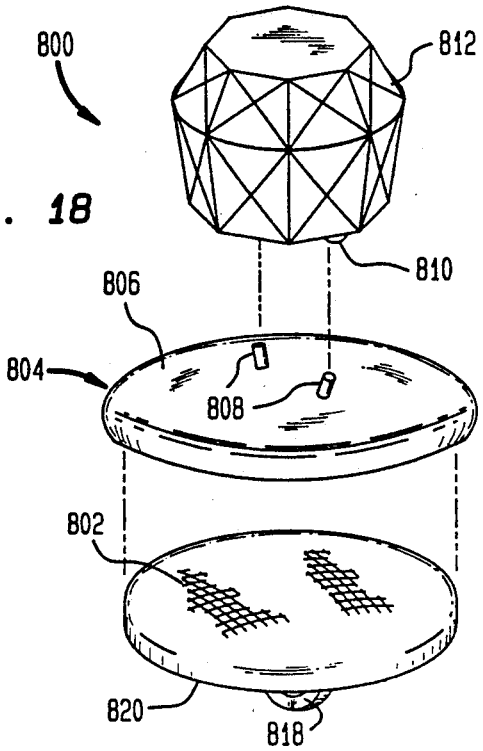
FIG. 18 is a schematic exploded showing of yet another alternative item of ornamentation in the configuration of a pin or broach incorporating the instant invention.

FIG. 18 shows yet another embodiment of ornamentation in the configuration of a pin or broach 800 incorporating the instant invention. A base member 802 is formed of relatively plain and conventional material and into a configuration and size to receive and carry a cover member 804 of a size and configuration to be received by and non-removably snap onto base member 802 in a manner substantially identical to the co-action between the base and cap members of previously described embodiments. Cover member 804 is formed from cloth covered or otherwise decorated and aesthetically pleasing ornamented material and so as receive on its surface 806 a first half 808 of fastening means such as a conventional fastener the other half 810 of which is carried by yet another element of ornamentation 812. Ornamentation 812 is smaller than snap type cover member 804 and fastener halves 808, 810 are preferably disposed to position ornamentation element 812 so as to be centered on cover member 804. A non-centered disposition for ornamentation element 812 on cover member 804 may also be selected. A conventional pin or clasp 818 is fixedly secured to a rear surface 820 of base member 802.

Ornamentation 800 of FIG. 18 may just as well be a button assembly or a different piece of jewelry such as a ring, pendant, bead, tie tack, one of a pair of earrings or the like with cover member 804 and element 812 comprising its decorative portions and with base members 802 serving as the base for the decorative portions. The size and configuration of such base member 802 and its decorative portions 804, 812 would be selected to provide the size and configuration appropriate to the type and kind of item. Pin or clasp 818 would be modified or removed and replaced by an appropriate and conventionally available attaching or carrying structure such as a finger loop for a ring, studs or clips for earrings, a loop for a pendant and the like, or an anchor or hook for a button.

Figure 19:
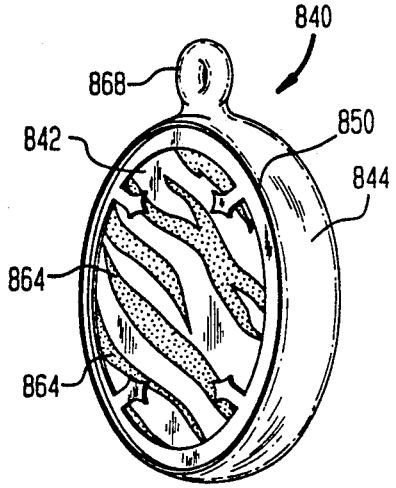
FIG. 19 is a perspective view of still a further alternative item of ornamentation in the configuration of a pendant incorporating the instant invention.
Figure 20:
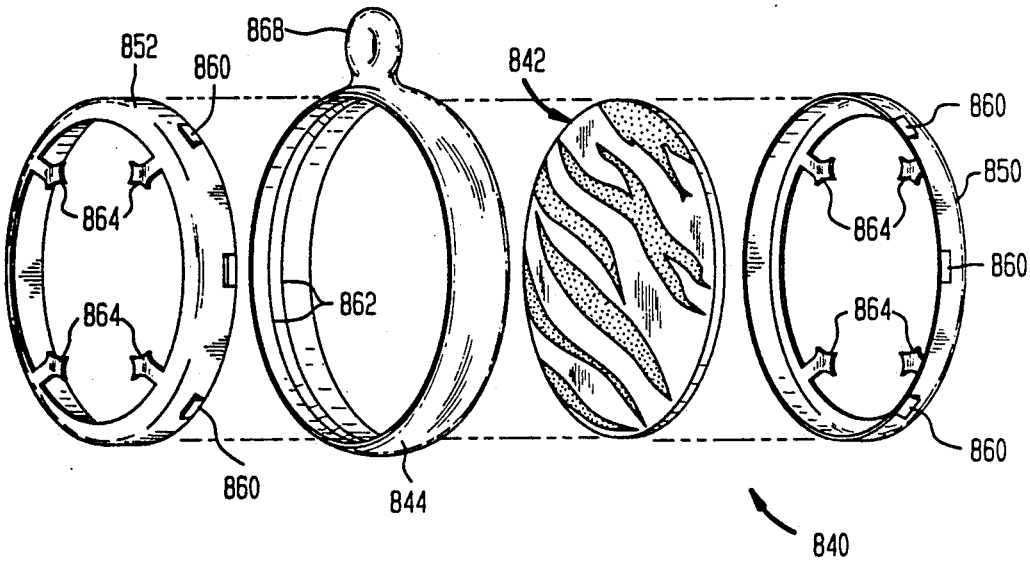
FIG. 20 is and exploded perspective view of the pendant of FIG. 19.

FIGS. 19 and 20 together show still another embodiment of ornamentation in the configuration of a pendant 840 incorporating the instant invention. An ornamentation element 842 in the configuration of a gem, semi-precious gem, stone, metal, metallic design, plastic bauble or similar aesthetically pleasing piece of costume or other jewelry type ornamentation is disposed within an outer cover 844 in the configuration of a ring. A pair of snap-in retainers 850, 852 (FIG. 20) are of a size and configuration to co-act with outer cover 844 and ornamentation element 842 to retain ornamentation element 842 in position within outer cover 844. Each snap-in retainer 850, 852 is provided with a number of latching elements 860 that co-act with a ridge-like circumferential lip 862 within outer cover to permanently seat and snap retainers 850, 852 and outer cover 844 together with ornamentation element 842 disposed therebetween as shown in FIG. 19. If preferred, latching elements 860 may be formed together as a continuous ring about the circumference of retainers 850, 852. A plurality of fingers 864 of selected configuration extend from each retainer 850, 852 to positions in front of ornamentation element 842 to further hold element 842 in position within cover 844 and retainers 860. A loop 868 of conventional construction extends out from cover 844 to facilitate hanging ornamentation 840 from a chain, rope, string or the like.

Figure 21:
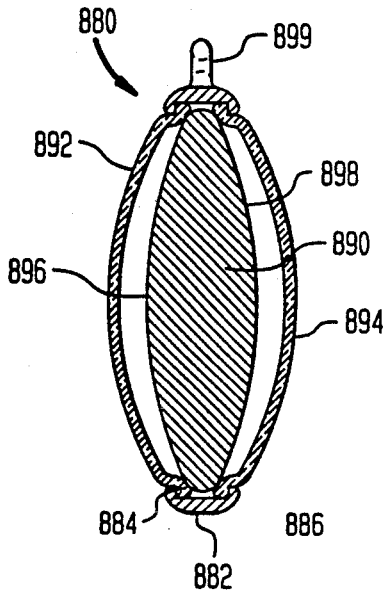
FIG. 21 is a vertical section through a still further alternative item of ornamentation in the configuration of yet another pendant incorporating the instant invention.

FIG. 21 shows yet still another embodiment of ornamentation in the configuration of another pendant 880 including an outer cover or ring 882 formed with circumferential lips 884, 886 and within which is disposed an ornamentation piece 890 which may be similar to ornamentation piece 842 of FIGS. 19 and 20 and similarly held in place. A front applique 892 and a rear applique 894 are disposed respectively on opposite sides 896, 898 respectively of ornamentation piece 890 and along with piece 890 are secured in position by lips 884, 886. The circumferential configuration of piece 890 and of appliques 892, 894 may be as desired and the decoration or configuration of appliques 892, 894 may also be as desired and either identical or different. A loop 899 of conventional construction is carried by ring 882 to facilitate hanging ornamentation 880 from a chain, cord, rope, or the like.

Figure 22:
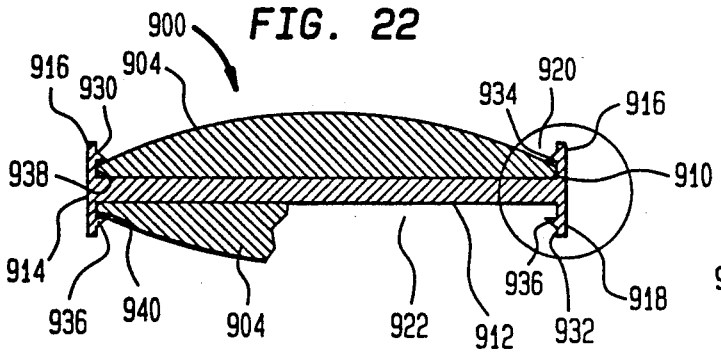
FIG. 22 is a vertical section of another alternative item of ornamentation in the configuration of a pendant incorporating the instant invention.
Figure 23:
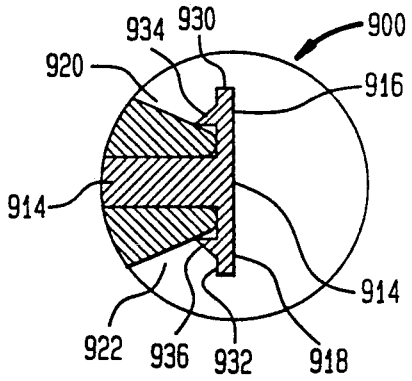
FIG. 23 is a detail of the circled portion of the pendant of FIG. 22 enlarged to better show details thereof.
Figure 24:
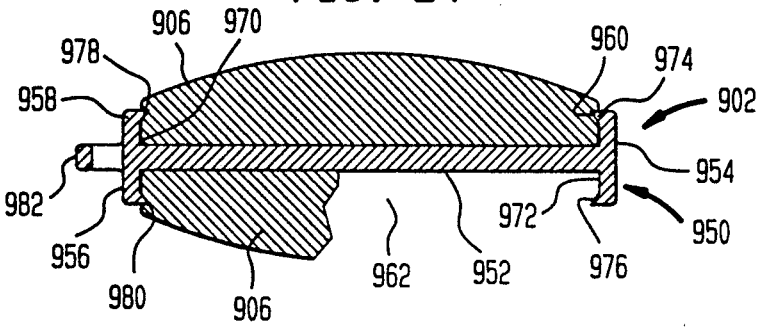
FIG. 24 is a vertical section of an alternative construction for retaining the decorative portion of the pendant of FIGS. 22 and 23 in on its base.

FIGS. 22, 23 and 24 show still other embodiments of ornamentation in this instance in the configuration of pendants 900 (FIGS. 22 and 23) and 902 (FIG. 24) each incorporating the instant invention. Each pendant 900, 902 mounts a pair of ornamentation pieces 904, 906 respectively which may be jewel or gem pieces such as cabochons or the like, pieces of semi-precious stones or of decorated or decorative metal, plastic, wood, ceramic or the like. The configuration, circumference, thickness, size specific material and its decorative finish are as may be selected by the skilled artisan.

A base member 910 is provided for pendant 900 and includes a rear wall 912 and a circumferential wall 914 with a first portion 916 extending in a first direction from rear wall 912 and a second portion 918 extending in a second direction from rear wall 918. Rear wall 918 is preferably centered with respect to circumferential wall 914 but may be otherwise disposed with respect to same as long as two spaces 920 and 922 are provided each of a size and configuration to receive a respective ornamentation piece 904.

Inner surfaces 930, 932 of circumferential wall 914 are each respectively formed with a circumferential rib 934, 936 disposed to snap over circumferential edges 938, 940 of ornamentation pieces 904 to hold and retain ornamentation pieces 904 in position within spaces 920, 922. If preferred ribs 934, 936 may e discontinuous or replaced by spaced latching members similar to those shown in the embodiment of FIG. 12. A conventional loop 940 is provided for pendant 900 to facilitate hanging pendant 900 from a chain, wire, rope, string, shoelace, or the like.

Pendant 902 also includes a base member 950 similar to base member 910 of pendant 900 in that it includes a rear wall 952 and a circumferential wall 954 providing a first portion 956 and a second portion 958 within which rear wall may be centered as shown in FIG. 24 or otherwise disposed. A first ornamentation space 960 is defined between first portion 956 and one surface of rear wall 952 and a second ornamentation space 962 is defined between second portion 958 and the other surface of rear wall 952. Spaces 960, 962 are each of a size and configuration to receive a respective ornamentation piece 906.

Inner surfaces 970, 972 of circumferential wall 954 are each respectively formed with a circumferential rib 974, 976 disposed to snap into and co-act with circumferential grooves 978, 980 respectively of ornamentation pieces 906 to hold and retain ornamentation: pieces in position within spaces 960, 962. If preferred ribs 974, 976 may be discontinuous or replaced by spaced latching members such similar to those shown in the embodiment of FIG. 12. A conventional loop 982 is provided for pendant 902 similar to loop 940 of pendant 900.

Base members 910, 950 may be fabricated from metal, plastic or other suitable material and with sufficient resilience for their respective circumferential walls, 914, 954 to facilitate disposition of their respective ribs for co-action with their respective ornamentation pieces.

When reference is made in this application to jewelry it is meant that jewelry like materials such as gold, silver or combinations thereof are used alone, and/or in combination with other jewelry materials such as glass, beads, semi-precious and precious stones and the like and that the surfaces of the materials, whether they be precious metals or wood, ceramic, plastic, glass or the like may be artistically decorated or not; thus encompassing all the various types of materials and finishes utilized in jewelry.

Figure 25:
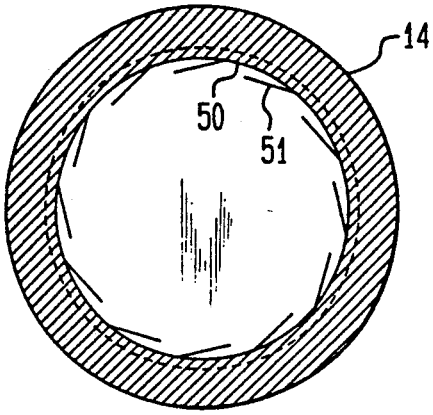
FIG. 25 shows a bottom cross-sectional view of another embodiment of the cap previously described in FIG. 1 showing catches which prevent cap rotation.

As heretofore described, the cap and base members, or combination cap and base with intermediate members are constructed in such a fashion that they are not removable from each other once assembled. Referring once again to FIG. 1 as one embodiment of this feature, once cap 14 is pressed onto base 12, rib 50 slips into groove 24. Rib 50 and groove 24 are fashioned so that they are not separable from one another. In one embodiment, the lower edge of rib 50 may be rounded but the top edge may be flat so that it will not slip in an upward direction out of groove 24. Alternatively, rib 50 may hook into groove 24 or into a channel within groove 24. In another preferred embodiment, the groove of the base member, or the cap member as the case may be, may be provided with a series of stop catches to prevent rotation of the cap with respect to the base. FIG. 25 shows a bottom cross-sectional view of another embodiment of the cap 14 previously described in FIG. 1. The cross section is made through rib 50 which is provided with a series of fan-like projections 51 which catch the inside of groove 24 and prevent rotation.

Figure 26:
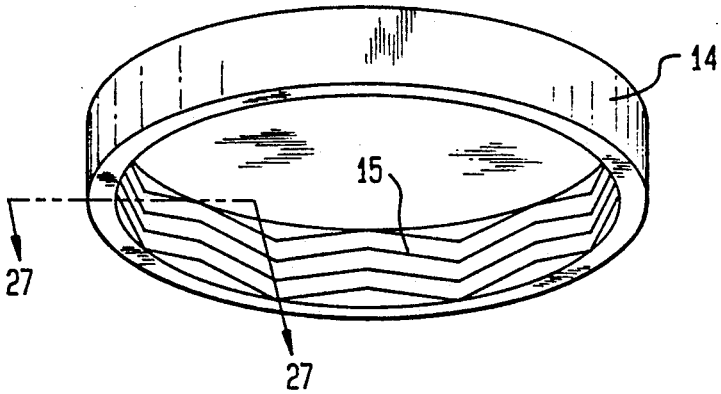
FIG. 26 shows a perspective view of another embodiment of the invention where the cap member is provided with chevron shaped catches for cooperation with a base member.
Figure 27:
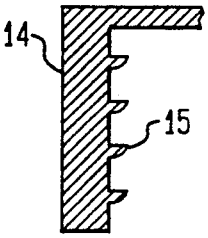
FIG. 27 shows a cross-sectional view of the cap member of FIG. 26.
Figure 28:
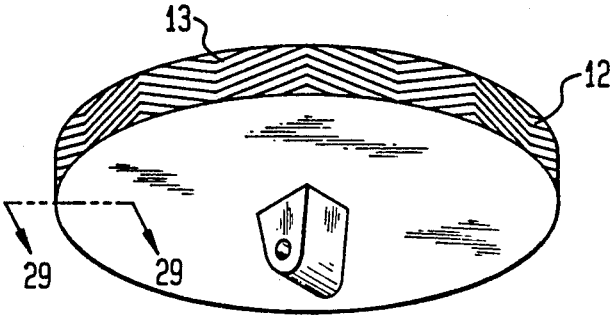
FIG. 28 shows a perspective view of another embodiment of the invention where the base member is provided with chevron shaped catches for cooperation with a cap member.
Figure 29:
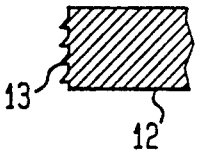
FIG. 29 shows a cross-sectional view of the base member of FIG. 28.

FIGS. 26–29 show another embodiment of the invention where cap member 14 and base member 12 are provided with complementary chevron member 13 and 15 respectively. Cap member 14 is provided with several V-shaped recesses which snap together with V-shaped raised portions 13 on the base member. Alternatively, the V-shaped raised portions can be on the inside of the cap member 14 and the recesses can be disposed on base 12. When the cap and base of FIGS. 26 and 28 are snapped together in a manner analogous to that of FIG. 1, the complementary chevrons engage and the cap and base are non-removably, non-rotatably and nonmovably attached. FIGS. 27 and 29 show cross-sectional views along lines 27—27 and 29–29 respectively of the chevron configured members of FIG. 26 and 28.

Figure 30:
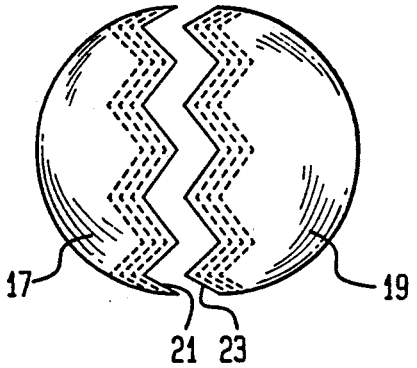
FIG. 30 shows a break-away perspective view of another embodiment of the invention where base and cap members are configured as a bead having internal complementary, raised and recessed chevron engagements.
Figure 31:
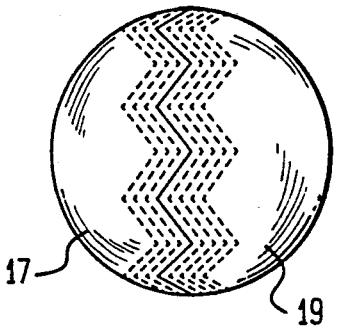
FIG. 31 shows a perspective view of the engaged bead of FIG. 30.
Figure 32:
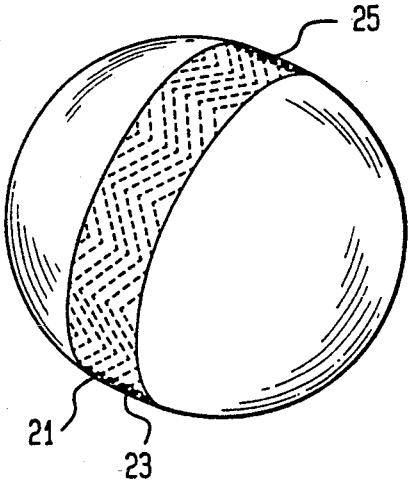
FIG. 32 shows a perspective view of the engaged bead of FIG. 30 with an additional ornamental band.

FIG. 30 shows another embodiment of the invention where a base member 17 and a cap member 19 are configured as a bead having complementary raised and recessed chevron engagement portions 21 and 23. FIG. 31 shows an outer view of such a bead when attached. FIG. 32 shows another attached bead having an ornamental band 25 and internal mating chevrons 21 and 23.

Figure 33:
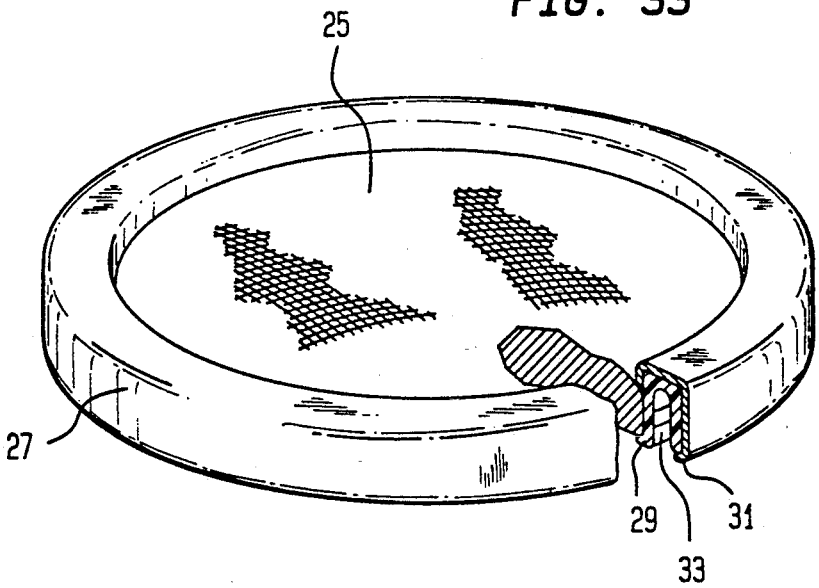
FIG. 33 shows a perspective view of another embodiment of a cap member.

FIG. 33 shows another embodiment of the invention wherein a cap member 25 is provided with a circumferential metal ring 27 around its outer periphery. Inside the ring is a plastic retainer 29. The retainer is held in place by edge 31 of the metal ring. Inside of the retainer 29 is annular channel 33 which has either groove or rib means as previously described for cooperation with the complementary base means. Similarly, this ring and retainer could be provided on the base means for cooperation and engagement with complementary cap means.

From the above description it will thus be seen that there has been provided new and novel ornamentation in the configuration of button assemblies and jewelry pieces which are constructed from bases, caps and intermediate members which snap together in selected combinations to provide a large and wide variety of ornamentations, jewelry pieces and buttons from a small number of individual members in a simple and efficient manner.

It is understood that although I have shown the preferred forms of my invention that various modifications may be made in the details thereof without departing from the spirit as comprehended from the following claims.

What is claimed is:

1. A button assembly comprising (a) button base means having (i) top and bottom surfaces joined by a peripheral side wall, which wall is in a plane substantially perpendicular to the bottom surface, and (ii) means for attaching said button assembly to an article;

(b) cap means comprising a cup-shaped member having a top surface, at least a portion of the top surface having been removed to permit viewing therethrough; a wall around the periphery of the top surface, which wall, together with the top surface defines a hollow center capable of receiving the button base means, said cap means being capable of co-action with and mounting to said button base means;

(c) at least one of said button base means and said cap means carrying securing means in the form of at least one protrusion extending outwardly from a wall of either the cap means or the button base means, each of said button base means, cap means and protrusion being comprised of materials providing a means capable of engaging and locking said button base means and cap means by snapping them together into a button assembly in the absence of supplied heat, which securing means permanently and non-removably secure said button base means and cap means together and prevents separation of the button base means and the cap means by a snap together engagement.

2. The assembly of claim 1, wherein said securing means comprising a first securing element in the form of rib means carried by either said base means or said cap means and a second securing element in the form of rib receiving means carried by the other of said base means or said cap means.

3. The assembly of claim 2, wherein said cap means carries said rib means upon a circumferential wall which surrounds and extends from a top of said cap means and wherein said circumferential wall is sufficiently resilient to surround said base means and cooperate with said rib receiving means.

4. The assembly of claim 3, wherein said rib means is continuous about the circumferential periphery of said cap means.

5. The assembly of claim 3, wherein said rib means is discontinuous and provides spaced latching elements disposed in spaced relationships about the circumferential periphery of said cap means.

6. The assembly of claim 2, wherein said base means carries said rib means upon a peripheral wall which surrounds and extends from a bottom of said base means and wherein said circumferential wall is resilient.

7. The assembly of claim 6, wherein said rib means is continuous about the peripheral wall of said base means.

8. The assembly of claim 6, wherein said rib means is discontinuous about the base means.

9. The assembly of claim 1, wherein said cap means includes a first cap member and a second cap member which together co-act with said base member to form the assembly.

10. The assembly of claim 9, wherein at least said first cap member carries a securing element in the form of a circumferentially disposed bead or rib and which is positioned to co-act with said base means.

11. The assembly of claim 10, wherein said predetermined portion of said base means with which said bead or rib co-acts is a lower peripheral edge of said base means.

12. The assembly of claim 11, wherein said bead or rib is continuous.

13. The assembly of claim 11, wherein said bead or rib is discontinuous and forms a plurality of spaced latching members.

14. The assembly of claim 11, wherein said first cap member and said second cap member are each formed with openings through selected portions thereof to facilitate viewing of the decorated portion of said base means.

15. The assembly of claim 1, further comprising at least one insert member disposed between said base means and said cap means.

16. The assembly of claim 1 wherein said securing elements comprise one or more raised chevron shaped wedge members positioned about an internal or external perimeter wall of said cap means or said base means, and oppositely, a plurality of complementary recessed chevron shaped wedge members positioned about an external or internal perimeter wall of said base means or said cap means whichever does not have the raised chevron members, said raised chevron members and said recessed chevron members being capable of a snap-together engagement with one another, which engagement substantially prevents the movement of said cap means with respect to said base means.

17. The assembly of claim 1 further comprising means for preventing said cap means and said base means from rotating about one another.

18. A button assembly comprising (a) button base means having (i) top and bottom surfaces joined by a smooth peripheral side wall, which wall is in a plane substantially perpendicular to the bottom surface, and (ii) a woven fabric covering the top surface, the peripheral side wall and at least a portion of the bottom surface, and (ii) means for attaching said button assembly to an article; and (b) cap means comprising a cup-shaped member having a top surface, and a wall around the periphery of the top surface, which wall, together with the top surface defines a hollow center capable of receiving the button base, the hollow center having a wall around its inner periphery; at least one protrusion extending outwardly from the inner periphery; each of said button base, cap and protrusion being comprised of materials providing a means capable of engaging and locking said button base and cap by snap together engagement of the protrusion with the bottom surface of the button base in the absence of applied heat to permanently and non-removably secure the button base and the cap together into a button assembly.

19. A button assembly comprising (a) button base means having (i) top and bottom surfaces joined by a peripheral side wall, which wall is in a plane substantially perpendicular to the bottom surface, and (ii) a plurality of holes through the top and bottom surface capable of engaging a thread for attaching said button assembly to a garment; and (b) a cap comprising a cup-shaped member having a top surface and a wall around the periphery of the top surface, which wall, together with the top surface defines a hollow center capable of receiving the button base, said cap being capable of co-action with and mounting to said button base;

(c) at least one of said button base means and said cap means carrying securing means in the form of at least one protrusion extending outwardly from a wall of either the cap means or the button base means; each of said button base, cap and protrusion being comprised of materials providing a means by snapping them locking said button base and cap means by snapping them together into a button assembly in the absence of supplied heat, which securing means permanently and non-removably secure said button base and cap together and prevents separation of the button base and the cap by a snap together engagement.

20. A button assembly method of attaching a button assembly to a garment which comprises:

(a) providing a button base having (i) top and bottom surfaces joined by a peripheral side wall, which wall is in a plane substantially perpendicular to the bottom surface, and (ii) means for attaching said button base to an article;

(b) providing a cap comprising a cup-shaped member having a top surface and a wall around the periphery of the top surface, which wall, together with the top surface defines a hollow center capable of receiving the button base, said cap means being capable of co-action with and mounting to said button base; at least one of said button base and said cap means carrying securing means in the form of at least one protrusion extending outwardly from a wall of either the cap means or the button base means and being capable of engaging and locking said button base means and cap means by snapping them together into a button assembly, which securing means permanently and non-removably secure said button base and cap together in the absence of applied heat, and prevents separation of the button base and the cap by a snap together engagement; and said button base and said cap being capable of both steps (i) and (ii);

(i) first attaching said base to an article and then forming a button assembly by snapping together said button base and said cap;

(ii) first forming a button assembly by snapping together said button base and said cap and then attaching said base to an article; and (c) performing either step (i) or step (ii).

21. An ornamental assembly comprising:

(a) base means including means for attaching said base means to an article;

(b) cap means for co-action with and mounting to said base means;

(c) at least one of said base means and said cap means carrying securing means in the form of at least one protrusion extending outwardly from a wall of either the cap means or the base means, each of said base means, cap means and protrusion being comprised of materials providing a means capable of engaging and locking said base means and cap means together by snapping them together, permanently non-rotatably and non-removably secure said base means and cap means together into an ornamental assembly, and which prevent separation of said base means and said cap means.

22. A method of producing a button assembly comprising:

(a) providing button base means including means for attaching said button base means to an article; and (b) providing cap means for co-action with and mounting to said base means; and (c) at least one of said button base means and said cap means carrying securing means in the form of at least one protrusion extending outwardly from a wall of either the cap means or the button base means and being capable of engaging and non-removably securing said button base means and cap means together by snapping them together into a button assembly in the absence of applied heat, said securing means permanently, now non-rotatably and non-removably secure said base means and cap means together and prevent separation of said base means and said cap means; and d) snapping together said button base means and said cap means.

* * * * *